US011136188B2

(12) United States Patent
Philipp et al.

(10) Patent No.: US 11,136,188 B2
(45) Date of Patent: Oct. 5, 2021

(54) WASTE COLLECTION VEHICLE WITH RAISED AND SLOPED HOPPER

(71) Applicant: Haul-All Equipment Ltd., Lethbridge (CA)

(72) Inventors: C. Kelly Philipp, Lethbridge (CA); Simon A. Hann, Lethbridge (CA)

(73) Assignee: Haul-All Equipment Ltd., Lethbridge (CA)

( * ) Notice: Subject to any disclaimer, the term of this patent is extended or adjusted under 35 U.S.C. 154(b) by 1187 days.

(21) Appl. No.: 14/011,350

(22) Filed: Aug. 27, 2013

(65) Prior Publication Data

US 2015/0059598 A1 Mar. 5, 2015

(51) Int. Cl.

| | |
|---|---|
| ***B30B 9/30*** | (2006.01) |
| ***B65F 3/20*** | (2006.01) |
| ***B65F 3/12*** | (2006.01) |
| ***B65F 1/14*** | (2006.01) |

(52) U.S. Cl.

CPC ..... *B65F 3/201* (2013.01); *B30B 9/301* (2013.01); *B30B 9/3042* (2013.01); *B30B 9/3046* (2013.01); *B65F 1/1405* (2013.01); *B65F 3/12* (2013.01); *B65F 3/207* (2013.01)

(58) Field of Classification Search

CPC ..... B30B 9/301; B30B 9/3082; B30B 9/3046; B30B 9/3042; B65F 3/12; B65F 3/20; B65F 3/207; B65F 3/201; B65F 1/1405; B65F 1/1615

USPC ..... 100/215, 229 A, 230, 245, 246, 251; 414/525.4, 525.2, 525.6, 525.55

See application file for complete search history.

(56) References Cited

U.S. PATENT DOCUMENTS

| | | | | | |
|---|---|---|---|---|---|
| 3,232,463 | A * | 2/1966 | Weir | B65F 3/205 | 414/493 |
| 3,252,600 | A * | 5/1966 | Sudac | B65F 3/28 | 100/295 |
| 3,325,024 | A * | 6/1967 | Shubin | B60P 1/50 | 100/295 |
| 3,828,663 | A * | 8/1974 | Poplinski | B30B 9/3096 | 100/218 |
| 4,096,959 | A * | 6/1978 | Schaffler | B65F 3/143 | 414/408 |
| 4,221,527 | A * | 9/1980 | Morrison | B65F 3/201 | 414/517 |
| 4,260,316 | A | 4/1981 | Gollnick | | |

(Continued)

FOREIGN PATENT DOCUMENTS

| | | | | |
|---|---|---|---|---|
| GB | 2110591 A * | 6/1983 | ..... | B30B 9/3046 |
| IN | 2010CH01392 | 12/2010 | | |
| JP | 60199599 A * | 10/1985 | ..... | B30B 9/3046 |

OTHER PUBLICATIONS

CA Office Action dated Mar. 31, 2015.

*Primary Examiner* — Jimmy T Nguyen

(74) *Attorney, Agent, or Firm* — Getz Balich LLC

(57) ABSTRACT

A organic waste collection vehicle includes a chassis, a rear container for containing waste material, the rear container being mounted on the chassis, a hopper connected to the rear container and spaced above the chassis, the hopper being furthermore sloped to flow liquid toward the rear container, an automatic bin-tipping mechanism for dumping organic waste from a waste bin into the hopper, and a packer for compacting the organic waste material.

11 Claims, 8 Drawing Sheets

(56) References Cited

U.S. PATENT DOCUMENTS

| | | | | |
|---|---|---|---|---|
| 4,757,758 | A * | 7/1988 | Tondo | B30B 9/3089 100/215 |
| 5,330,307 | A * | 7/1994 | Spiers | B30B 9/3046 414/406 |
| 5,584,642 | A * | 12/1996 | Huntoon | B65F 3/001 414/408 |
| 6,210,094 | B1 | 4/2001 | McNeilus et al. | |
| 6,776,570 | B1 * | 8/2004 | Thobe | B30B 9/3082 414/510 |
| 6,854,949 | B2 * | 2/2005 | Huang | B65F 3/28 414/492 |
| 7,124,680 | B2 * | 10/2006 | Poss | B30B 9/3003 100/193 |
| 7,997,852 | B1 * | 8/2011 | Campbell | B65F 3/201 414/812 |
| 2003/0089250 | A1 * | 5/2003 | Brzezniak | F16C 29/045 100/240 |
| 2005/0123384 | A1 * | 6/2005 | Tomassoni | B65F 3/001 414/525.2 |
| 2009/0065617 | A1 * | 3/2009 | Yamada | B65F 3/00 241/101.01 |
| 2013/0084159 | A1 | 4/2013 | Warren et al. | |

* cited by examiner

WASTE COLLECTION VEHICLE WITH RAISED AND SLOPED HOPPER

CROSS-REFERENCE TO RELATED APPLICATIONS

This is the first application filed for the present invention.

TECHNICAL FIELD

The present invention relates generally to waste collection vehicles and, in particular, to organic waste collection vehicles.

BACKGROUND

Waste collection vehicles such as garbage trucks and recycling trucks are used by municipalities to collect garbage and recyclable materials. Many municipalities have now begun to also collect organic waste material that residents are asked to place in a third (e.g. green) bin to facilitate segregation from the waste and recyclable streams. Organic waste may include fruit, vegetables, bread, cereals, pasta, dough, tea bags, meat scraps, coffee grinds, etc. which can be composted for subsequent use on farms, parklands and gardens. On aggregate, the physical consistency of organic waste material is very different from garbage. For example, organic waste is typically of higher density, with much more liquid than traditional garbage. Conventional waste collection vehicles are thus not particularly well suited for collecting organic waste material.

A need therefore exists for an improved waste collection vehicle that is better suited to the specific task of collecting organic waste material.

SUMMARY

In general, the present invention provides a waste collection vehicle with a raised and sloped loading hopper that is particularly well suited for collecting organic waste material. The raised and sloped hopper causes liquid waste to flow toward the rear container. In other words, the raised and sloped hopper substantially prevents liquid waste from flowing back into the hopper or out of a forward end of the hopper into the drop chute. Liquid waste may be trapped in the corners of the hopper, leading to rotting and rusting of the hopper. The vehicle may also include a packer and an extrusion collar for compacting the organic waste as the waste is extruded through the extrusion collar into the rear compartment by the packer. The packer and extrusion collar thus pre-compact the organic waste as it enters the rear compartment. This arrangement is believed to improve overall compaction efficiency.

Accordingly, one aspect of the present invention is a waste collection vehicle that includes a chassis, a rear container for containing waste material, and a raised hopper that is spaced above the chassis for receiving the waste material, wherein the hopper is also sloped downwardly in a rearward direction.

Another aspect of the present invention is a method of collecting waste using a waste collection vehicle. The method entails dumping the waste into a raised and sloped hopper that is spaced a vertical distance above a chassis of the vehicle and that is sloped toward a rear container mounted to the chassis. The method further entails compacting the waste by actuating a packer that causes the waste to be transferred into the rear container.

Yet another aspect of the present invention is an organic waste collection vehicle that includes a chassis, a rear container for containing waste material, the rear-container being mounted on the chassis, a hopper connected to the rear container and spaced above the chassis, the hopper being furthermore sloped to flow liquid toward the rear container. The vehicle further includes an automatic bin-tipping mechanism for dumping organic waste from a waste bin into the hopper and a packer for compacting the organic waste material.

Yet a further aspect of the present invention is a waste compactor that includes a container for containing waste material and a raised hopper that is spaced above a bottom of the container for receiving the waste material, wherein the hopper is also sloped downwardly in a rearward direction.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
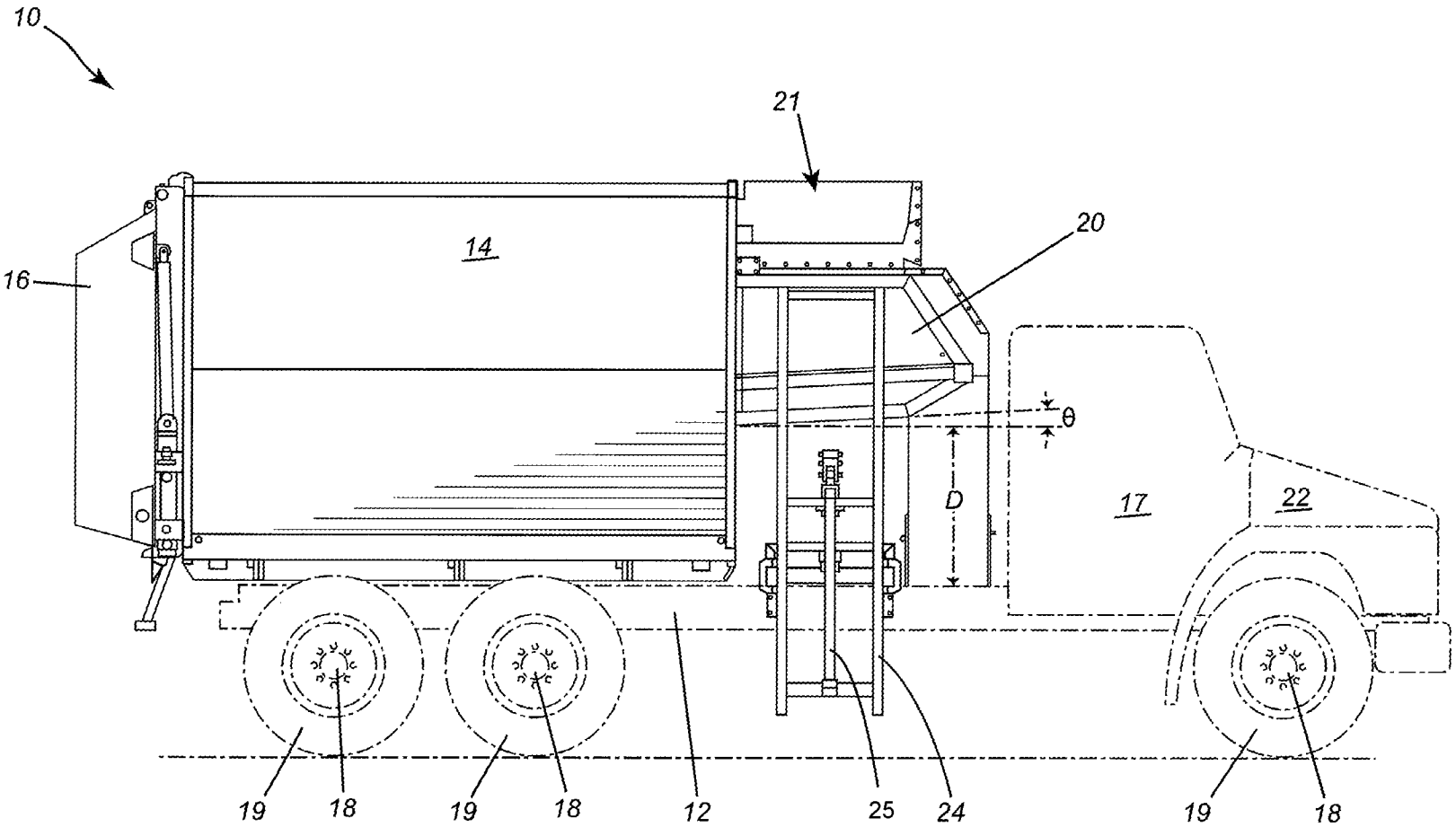
FIG. 1 is a side view of a waste collection vehicle in accordance with an embodiment of the present invention.

A waste collection vehicle, generally designated by reference numeral 10, is illustrated by way of example in FIG. 1.

In the embodiment illustrated in FIG. 1, the waste collection vehicle 10 includes a chassis 12 (or frame) and a rear container 14 for containing waste material. The rear container 14 includes a tailgate 16 that pivotally opens to enable waste to be dumped from the rear container 14. The chassis 12 also supports a cab 17 as well as axles 18 having wheels and tires 19.

The waste collection vehicle 10 includes a raised hopper 20 that is spaced above the chassis by a vertical distance denoted by D in FIG. 1. The hopper is positioned and shaped to receive the waste material. Specifically, the hopper of FIG. 1 includes an inlet 21 which may have a splash guard. The hopper is also sloped downwardly in a rearward direction as shown in FIG. 1. The rearward direction is defined as rearward relative to a forward direction of travel of the vehicle. In one embodiment, the hopper is sloped at an angle θ of 1 to 10 degrees although steeper angles may be employed. In the specific embodiment illustrated in FIG. 1, the hopper is sloped at an angle θ of 4 degrees.

The chassis 12 also supports an internal combustion engine under a hood 22. The engine may be mounted to a front portion of the chassis as shown in FIG. 1. The engine may be any suitable internal combustion engine such as a four-stroke diesel engine or gasoline engine but it may also be a hybrid gas-electric engine or an electric motor with a battery or capacitor pack. It should be appreciated that any type of engine, motor or propulsion system may be employed. The engine provides power to drive hydraulic systems to raise (or pivotally raise) the rear container 14 and also to drive an automatic bin-tilting mechanism 24. The automatic bin-tipping mechanism 24 dumps organic waste material from an organic waste bin into the inlet 21 of the hopper 20. The automatic bin-tipping mechanism 24 includes a hydraulic actuator 25 and chain (not shown) for grasping and rotating (tilting) the organic waste bin or cart ("green bin") so as to invert the bin (or cart) above the inlet 21 to thereby dump its contents into the inlet 21 of the hopper 20.

The vehicle also includes a transmission system for driving one or more axles of the vehicle. The vehicle is shown as having three axles with front wheels and rear wheels for supporting the weight of the container although the vehicle may have any other number of axles or wheels. The vehicle may, of course, include other systems, subsystems and components not explicitly described herein, such as a braking system, steering system, electrical system, heating and air conditioning systems, navigation system, radio communication system, etc.

Figure 2:
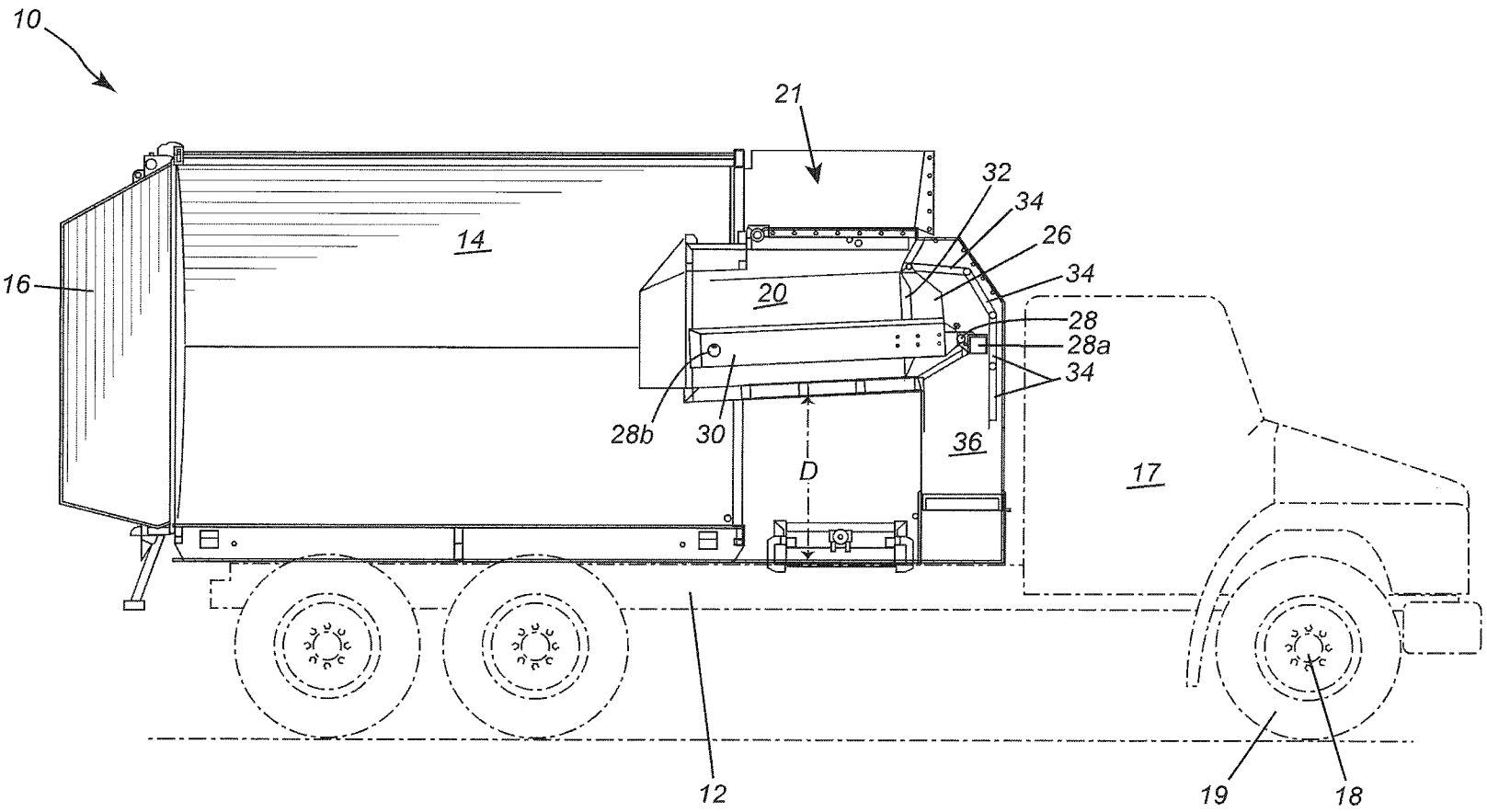
FIG. 2 is a side cutaway view of the vehicle of FIG. 1 showing the raised and sloped hopper and the packing mechanism.

FIG. 2 illustrates a packer 26 that is actuated by an actuator (e.g. hydraulic actuator) 28 to displace (and compact) waste material from the hopper 20 into the rear container 14. The packer 26 includes an elongated bullnose 30 and a packer face 32 affixed to the elongated bullnose 30. The bullnose 30 may also be referred to as a spearhead packer, a probe-faced packer or a packer head. The actuator (e.g. a hydraulic actuator) 28 is disposed within, or at least partially within, the elongated bullnose 30 to extend and retract the packer 26. The actuator 28 is connected at a first end to a transverse member **28*a* (which is immovably mounted to the vehicle) and is connected at a second end to a pin 28*b*** mounted to the bullnose.

As depicted by way of example in FIG. 2, the vehicle 10 further includes a plurality of articulated follower plates 34 connected to the packer 26 to move with the packer. There are four articulated follower plates 34 illustrated in FIG. 2 although the number of follower plates may be varied in other embodiments. The follower plates 34 are displaced from a first open position (shown in FIG. 2) in which the plates are retracted at least partially into a drop chute 36 disposed below a forward portion of the hopper (to open an inlet of the hopper) and a second closed position in which the plates 34 are extended across the inlet of the hopper to thereby close the inlet of the hopper. The follower plates thus prevent waste from falling belatedly from the tilted bin through the inlet of the hopper and onto the extended actuator when the packer is extended. When the packer is extended, so are the plates, thereby closing off the inlet and protecting the actuator from further falling waste that may not have fallen out of the bin initially. When the packer is retracted to its home position, the plates are retracted, thereby re-opening the inlet so that waste can fall into the hopper once again.

Figure 3:
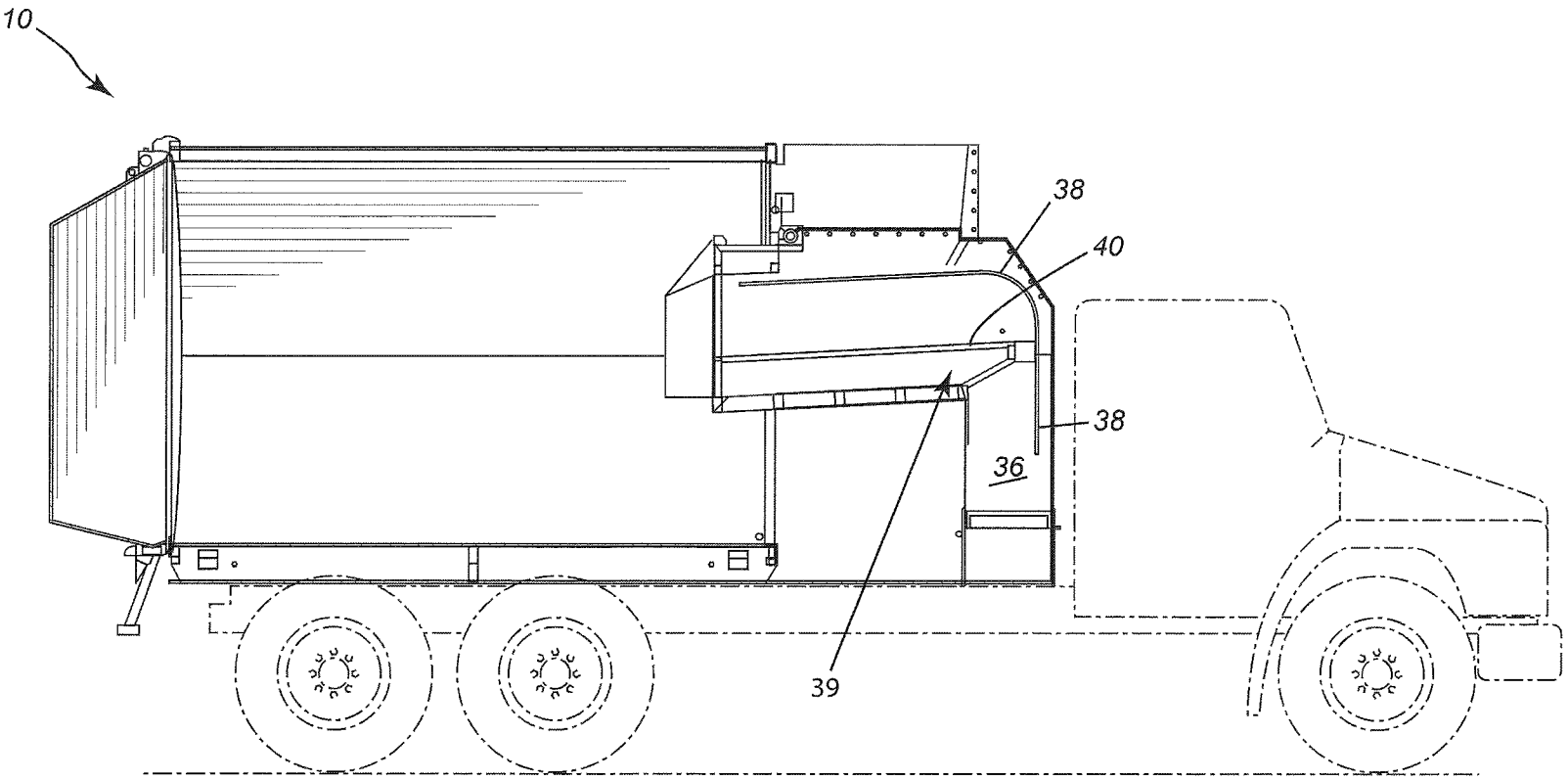
FIG. 3 is a side cutaway view of the vehicle of FIG. 1 showing the tracks for guiding the follower plates and for guiding the packer.

The follower plates 34 are guided by one or more tracks 38 shown in FIG. 3. This figure also shows the side tracks 40 that are used to guide the packer as it extends and retracts within the hopper. The side tracks are disposed along internal side walls of the hopper. As illustrated the side tracks are angled at substantially the same angle as the sloped floor of the hopper, i.e. the side tracks are parallel to the floor of the hopper to ensure that the packer face slides smoothly across the floor of the hopper. Also illustrated in FIG. 3 is a lip 39 (or ridge) along the floor of the hopper that substantially prevents water or liquid waste from flowing into the drop chute while still allowing errant waste material to be dragged back into the drop chute during a return stroke of the packer.

Figure 4:
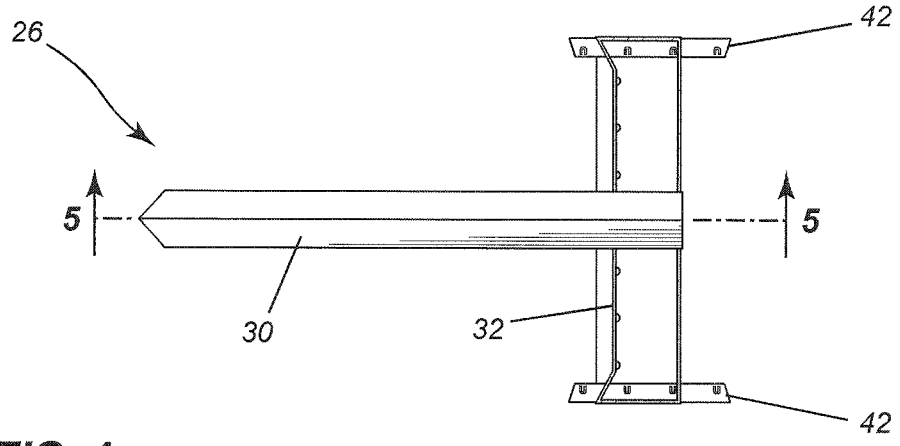
FIG. 4 is a top view of the packer.
Figure 5:
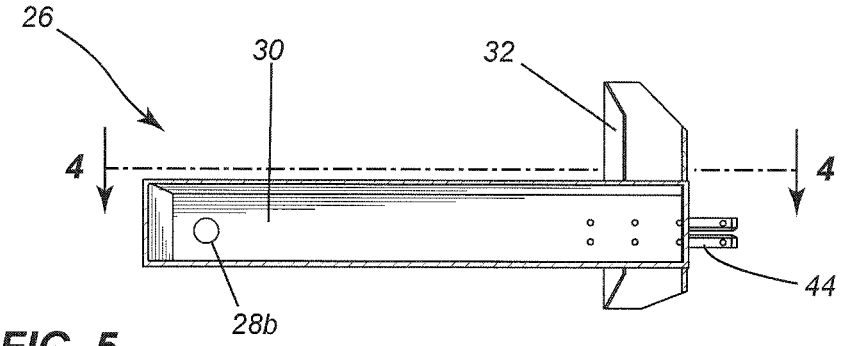
FIG. 5 is a side view of the packer.

FIGS. 4 and 5 depict the packer 26 in top and side views, respectively. Specifically, FIG. 4 is a sectional view taken through section B-B in FIG. 5 whereas FIG. 5 is a sectional view taken through section A-A in FIG. 4. The details of the elongated bullnose 30 and packer face 32 are illustrated in these figures. The packer face may be concave with flared side guards to improve sweep efficiency and minimize errant waste. The bullnose may terminate in a sharp, pointed or knife-edged end as shown in these figures. The packer face may be affixed symmetrically to the bullnose in the plan view but asymmetrically in the side view. The packer face may be affixed to the bullnose by welding. The packer face may include a flat inner surface with angled/conical peripheral (or outer) surfaces as shown. In variants, the packer face may have other configurations such as an entirely flat surface, a concave surface, etc.

As depicted in FIG. 4, the packer 26 further comprises guide plates 42 affixed laterally to the packer face for sliding along the side tracks 40 on the internal side walls of the hopper.

As depicted in FIG. 5, the packer 26 has a yoke or other attachment mechanism 44 for connecting the actuator to the transverse member **28*a***.

Figure 6:
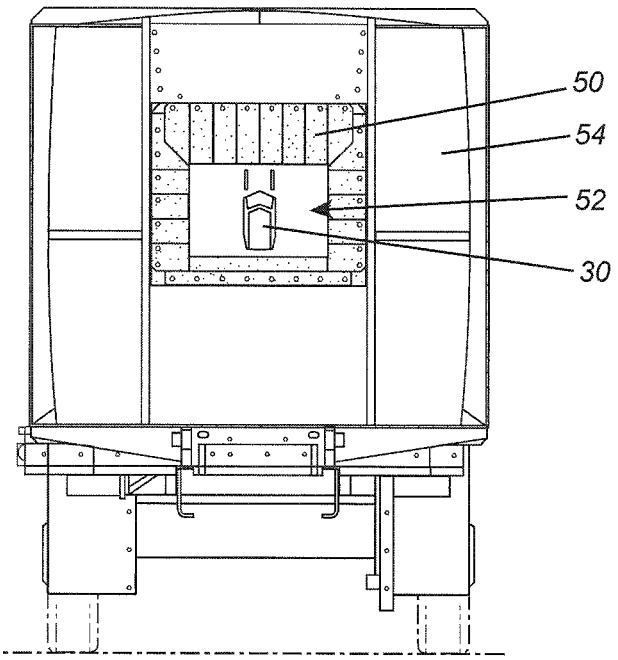
FIG. 6 is a rear cutaway view of the vehicle of FIG. 1 showing the extrusion collar.
Figure 7:
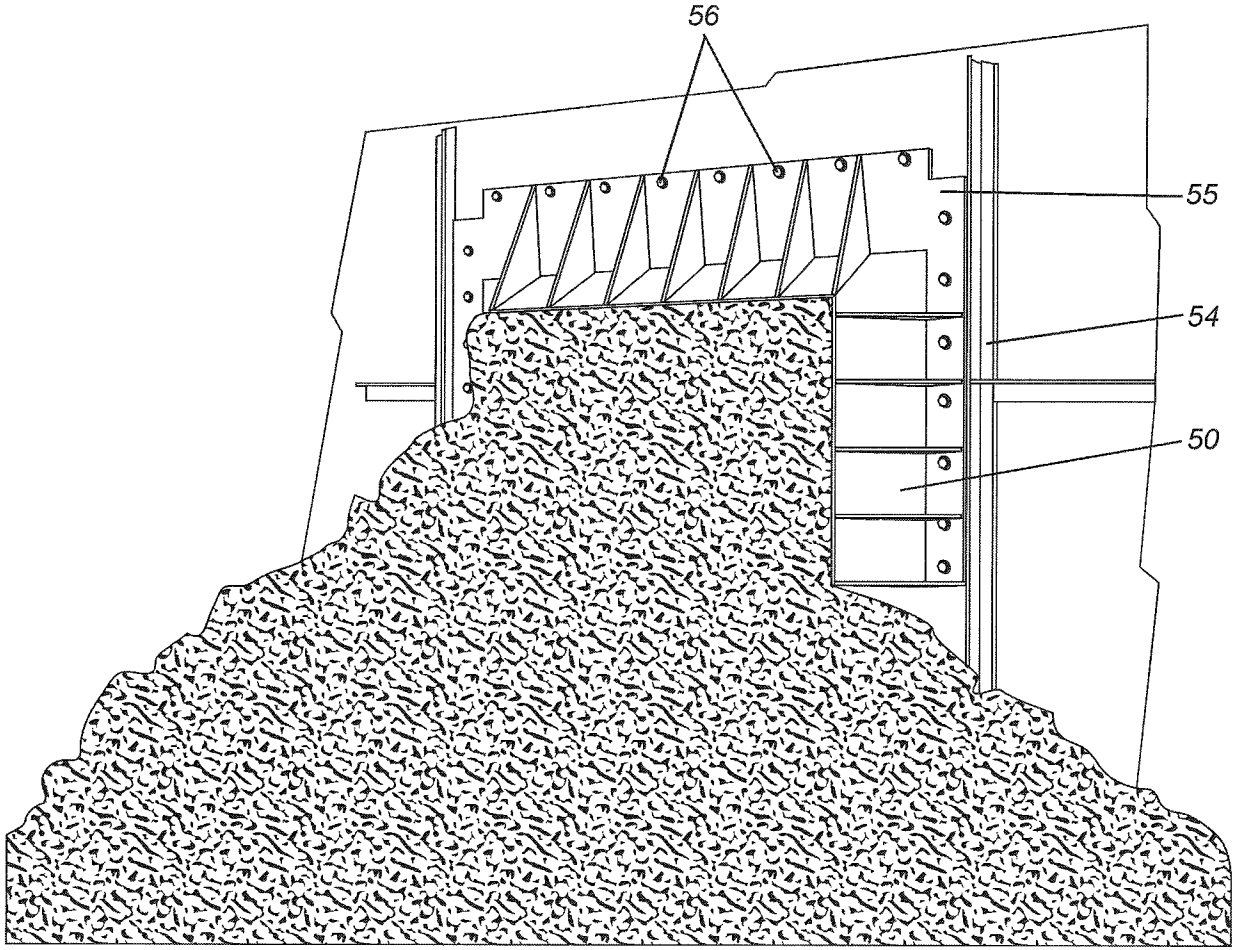
FIG. 7 is an enlarged isometric view of the front of the extrusion collar.
Figure 7A:
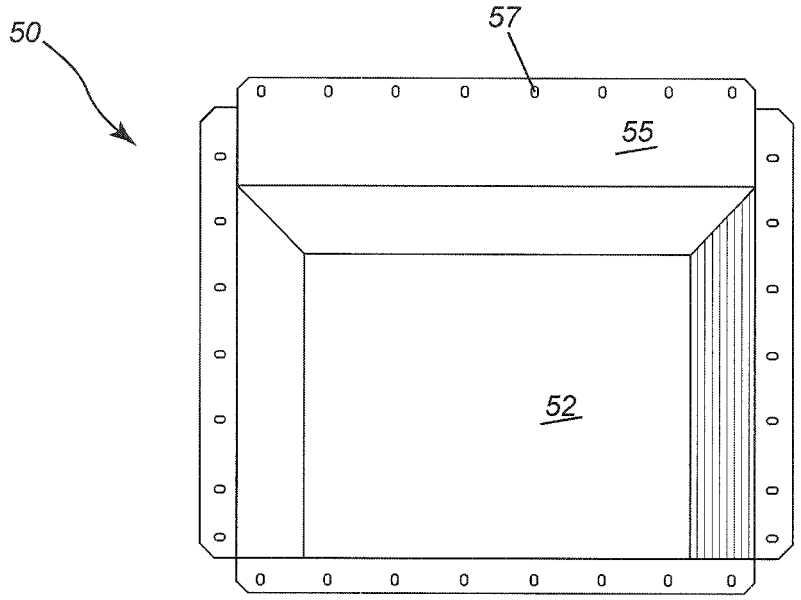
FIG. 7*a* is a side view of the extrusion collar.
Figure 7C:
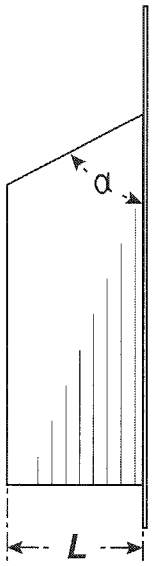
FIG. 7*c* is a side view of the extrusion collar.
Figure 7B:
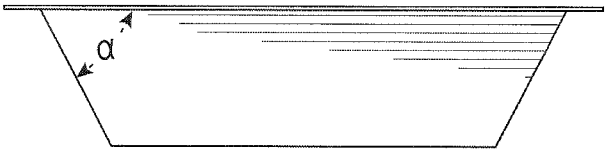
FIG. 7*b* is an isometric view of the rear of the extrusion collar.
Figure 7D:
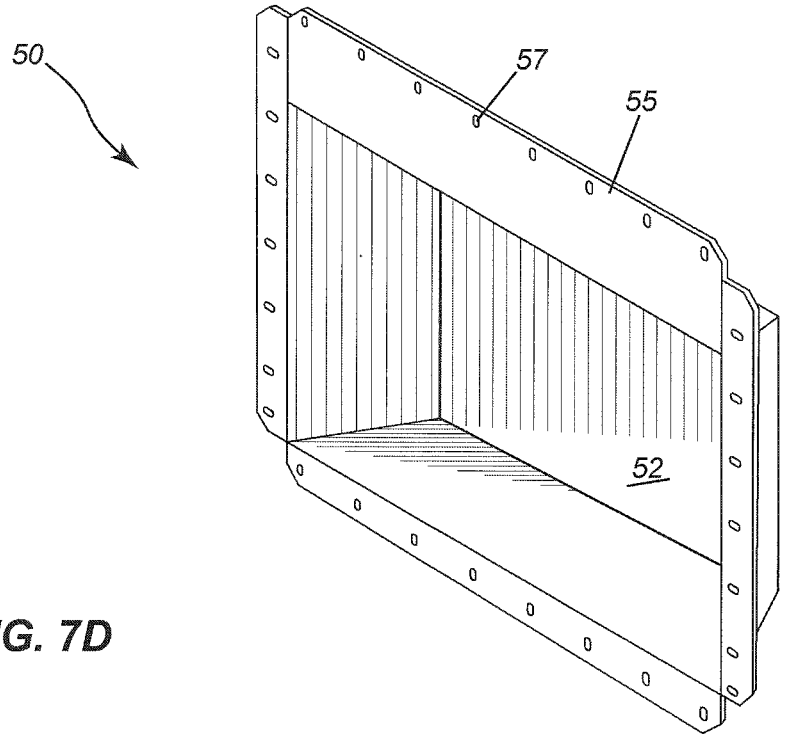
FIG. 7*d* is an isometric view of the extrusion collar.

In the embodiment depicted in FIG. 6 and FIG. 7, the vehicle further includes an extrusion collar 50 which is a duct-like structure defining an opening 52 at an interface 54 (or wall) between the hopper and the rear container. The opening 52 may be rectangular in cross-section or it may be any other suitable shape such as conical. The packer cooperates with the extrusion collar to compact the waste material as the waste material is extruded through the extrusion collar into the rear container. The bullnose 30 of the packer protrudes through the opening into the rear compartment when the actuator is fully extended. The extrusion collar 50 may have a flange 55 having holes 57 through which the collar is fastened to the interface or wall 54. Threaded fasteners 56 such as bolts or screws may be used to fasten the flange 55 of the extrusion collar 50 (via the holes 57) to the interface or wall 54. In one embodiment, the extrusion collar 50 defines a converging section (shown in FIG. 7), i.e. a section that converges in a rearward direction. This converging section may have an angle of convergence a of 35 to 71 degrees and a length L of 4 to 11 3/16 inches (10 to 28 cm) as further illustrated by way of example in FIGS. 7*a* and 7*b*. The extrusion collar may have triangular reinforcing ribs to enhance the structural rigidity of the extrusion collar. In operation the packer face compacts the waste material through the converging extrusion collar into the rear compartment when the actuator is extended. The waste is thus compacted as it passes through the collar into the rear compartment. Since compaction occurs as the waste passes into the rear compartment (as opposed to compacting the waste inside the compartment), this is known as pre-compaction of waste, which is believed to be more space efficient. The packer also drags errant waste material into the drop chute 36 when the actuator retracts the packer. Errant waste means any waste material that has not been captured during the push stroke of the packer. This errant waste is dragged or pulled into the drop chute as the actuator retracts the packer.

Another aspect of the present invention is a method of collecting organic waste using a waste collection vehicle. In broad terms, the method entails steps or acts of (i) dumping the waste into a raised and sloped hopper that is spaced a vertical distance above a chassis of the vehicle and that is sloped toward a rear container mounted to the chassis and (ii) compacting the waste by actuating a packer that causes the waste to be transferred into the rear container. In one implementation, compacting the waste may be done by extruding the waste through an extrusion collar defining an opening between the hopper and the rear container. The method may further entail displacing a plurality of follower plates with the packer as the packer moves within the hopper. Dumping the waste may be accomplished by tilting an organic waste bin using an automatic bin-tipping mechanism to dump waste into an upper inlet of the hopper, the inlet being selectively opened and closed by the follower plates that follow the packer as the packer moves within the hopper.

The hopper of the vehicle may also include a bidirectionally folding lid that also functions as a splash guard and crusher panel. This lid may open left-to-right or right-to-left depending on which side of the vehicle the material is dumped into the hopper. This bidirectional lid facilitates side loading by providing unobstructed access from both the left and right sides of the vehicle while also providing the benefits of a splash guard.

FIGS. 8*a*-8*f* show one embodiment of a bidirectionally folding lid assembly 60. These figures show a cylinder barrel 61, a lid hinge plate 62, a sliding pin latch plate 63, a lid weldment 64 (or support rib) and a cylinder rod 65. These figures also show a lid face 66 that functions as a splash guard and crusher panel, a pair of spaced-apart mounts 67, a crossbar 68, a first U-shaped pivot groove 69, a second U-shaped pivot groove 70, a first transverse bar 71 with pin extensions 71*a* shaped and dimensioned to engage the first U-shaped pivot groove 69, and a second transverse bar 72 with pin extensions 72*a* shaped and dimensioned to engage the second U-shaped pivot groove 70. The cylinder barrel 61 and cylinder rod 65 together constitute a hydraulic actuator. As shown in this embodiment, there are two parallel actuators to actuate the lid mechanism although one actuator may be used in another embodiment.

Figure 8A:
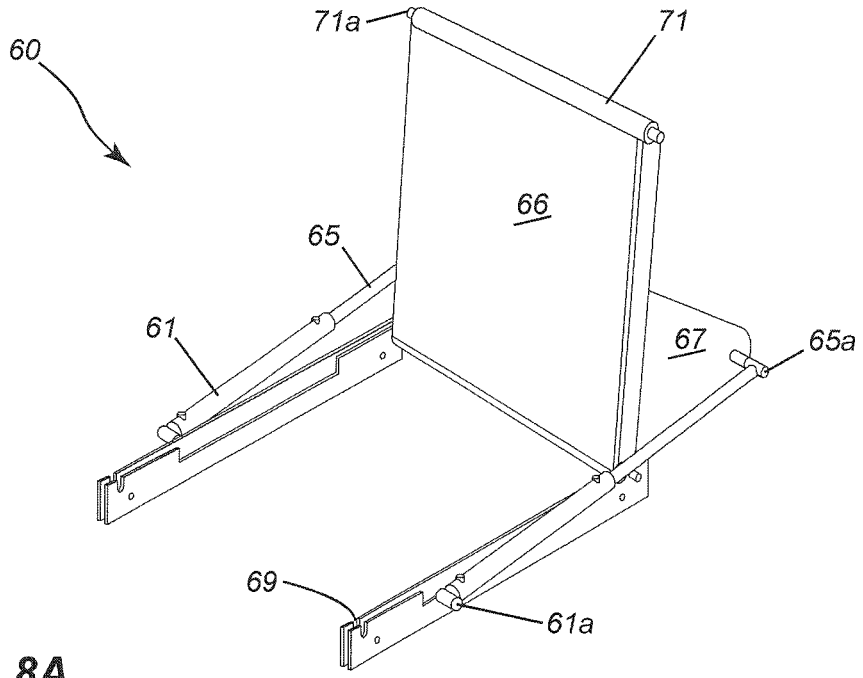
FIG. 8*a* is an isometric view of the lid assembly in the driver side loading configuration.
Figure 8B:
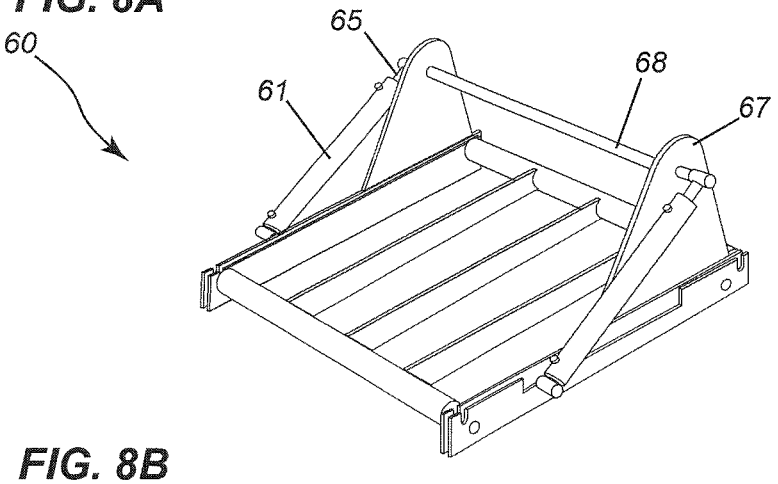
FIG. 8*b* is an isometric view of the lid assembly in the transport configuration.
Figure 8C:
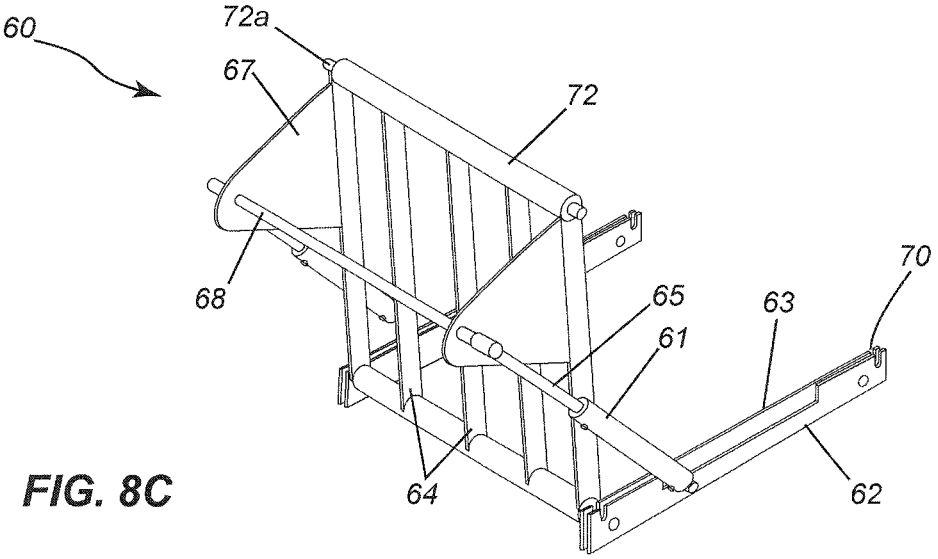
FIG. 8*c* is an isometric view of the lid assembly in the passenger side loading configuration.
Figure 8D:
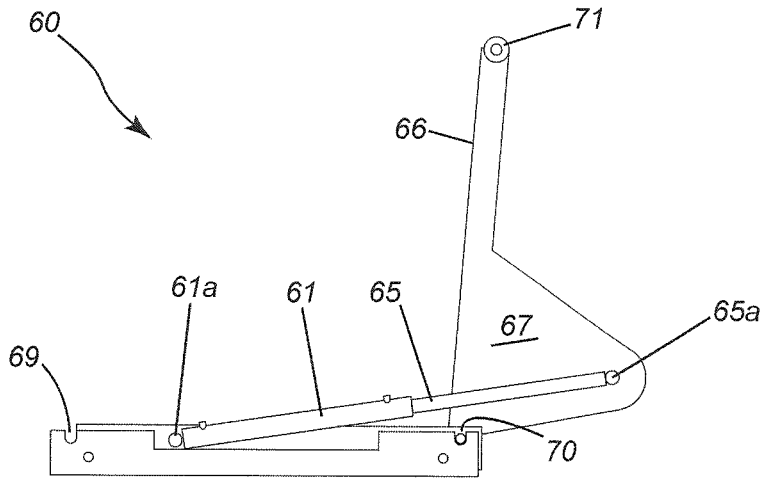
FIG. 8*d* is a side view of the lid assembly in the driver side loading configuration.
Figure 8E:
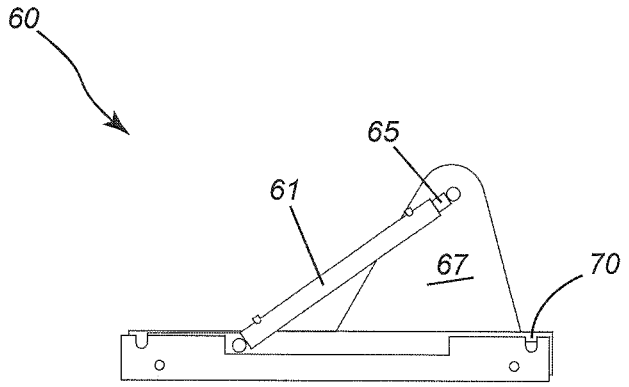
FIG. 8*e* is a side view of the lid assembly in the transport configuration.
Figure 8F:
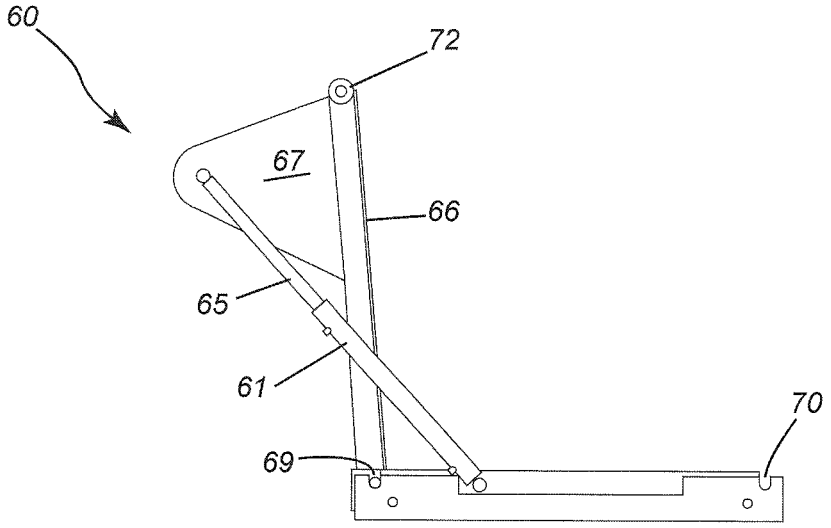
FIG. 8*f* is a side view of the lid assembly in the passenger side loading configuration.

In the left-hand side loading configuration (driver's side loading), the lid assembly is folded open as shown in FIG. 8*a* and FIG. 8*d*. The slider is fully engaged on the right-hand side, locking the corresponding hinge pin in its groove. In the transport configuration, shown in FIG. 8*b* and FIG. 8*e*, the slider is in the central position, thus engaging both lid hinge pins and thereby locking the lid shut. In the right-hand side loading configuration (passenger side loading) of FIG. 8*c* and FIG. 8*f*, the slider is engaged on the left-hand side, locking the corresponding hinge pin in its groove. In other words, in the posture of FIGS. 8*a* and 8*d*, the lid pivots about U-shaped grooves 70 because pins 72*a* engage the grooves 70 and are locked in place by the sliding pin latch plate 63 which slides due to the actuator, providing a pivot point for the lid. In the posture of FIGS. 8*c* and 8*f*, the pins 71*a* engage the first U-shaped grooves 69 and are locked in place by the sliding pin latch plate 63, providing a pivot point for the lid. The actuators are mounted eccentrically to the mounts 67 to permit bidirectional folding of the lid mechanism.

This invention has been described in terms of specific examples, embodiments, implementations and configurations which are intended to be exemplary only. Persons of ordinary skill in the art will appreciate that obvious variations, modifications and refinements may be made without departing from the scope of the present invention. The scope of the exclusive right sought by the Applicant is therefore intended to be limited solely by the appended claims.

The invention claimed is:

1. A waste collection vehicle comprising:

a chassis;

a rear container for containing waste material; and a raised hopper having a sloped bottom member that is spaced above the chassis for receiving and supporting the waste material above the chassis irrespective of a position of the rear container, wherein the sloped bottom member of the raised hopper is sloped downwardly in a rearward direction toward a tailgate of the rear container; and a packer that is spaced above the chassis and facing the tailgate, the packer is disposed for slidable translation within the raised hopper and wherein the packer is reciprocated linearly by an actuator to displace waste material from the raised hopper into the rear container.

2. The vehicle as claimed in claim 1 further comprising an extrusion collar defining an opening at an interface between the raised hopper and the rear container, the packer cooperating with the extrusion collar to compact the waste material as the waste material is extruded through the extrusion collar into the rear container.

3. The vehicle as claimed in claim 2 wherein the extrusion collar defines a converging section having an angle of convergence of 35-71 degrees and a length of 4-11 3/16 inches (10-28 cm).

4. The vehicle as claimed in claim 3 wherein the sloped bottom member of the raised hopper is sloped at an angle greater than 0 degrees and less than or equal to 10 degrees.

5. The vehicle as claimed in claim 4 wherein the sloped bottom member of the raised hopper is sloped at an angle of 4 degrees.

6. The vehicle as claimed in claim 1 wherein the packer comprises:

an elongated bullnose; and a packer face affixed to the bullnose; and wherein the actuator is a hydraulic actuator within the bullnose to extend and retract the packer.

7. The vehicle as claimed in claim 6 wherein the packer further comprises guide plates affixed laterally to the packer face for sliding along side tracks on internal side walls of the raised hopper.

8. The vehicle of claim 1, wherein the raised hopper includes a top member spaced from the sloped bottom member, the top member including an inlet extending through the top member.

9. A waste collection vehicle comprising:

a chassis;

a rear container for containing waste material; and a raised hopper having a sloped bottom member that is spaced above the chassis for receiving and supporting the waste material above the chassis irrespective of a position of the rear container, wherein the sloped bottom member of the raised hopper is sloped downwardly in a rearward direction; and a packer that is spaced above the chassis to interact with the raised hopper and wherein the packer is actuated by an actuator to displace waste material from the raised hopper into the rear container; and a plurality of articulated follower plates connected to the packer to move with the packer, the follower plates being displaced from a first open position in which the plates are retracted at least partially into a drop chute disposed below a forward portion of the raised hopper to open an inlet of the raised hopper and a second closed position in which the plates are extended across the inlet of the raised hopper to thereby close the inlet of the raised hopper.

10. The vehicle as claimed in claim 9 wherein the packer compacts the waste material through an extrusion collar into the rear container when extended and drags errant waste material into the drop chute when retracted.

11. The vehicle as claimed in claim 9 further comprising an automatic bin-tipping mechanism for dumping the waste material from a waste bin into the inlet of the raised hopper.

* * * * *